United States Patent [19]

Williams et al.

[11] 4,045,665

[45] Aug. 30, 1977

[54] DIFFUSER ATTACHMENT FOR A FLUORESCENT LAMP FIXTURE

[75] Inventors: Harrison L. Williams, Euclid; Detre M. Banhidy, Lakewood, both of Ohio

[73] Assignee: Preformed Line Products Co., Cleveland, Ohio

[21] Appl. No.: 590,307

[22] Filed: June 25, 1975

[51] Int. Cl.[2] ..... H05B 33/02

[52] U.S. Cl. ..... 240/51.11 R; 240/106 R

[58] Field of Search ..... 240/51.11 R, 51.12, 240/92, 106, 151, 106 R, 106.1, 1.1, 11.4 R, 11.4 A

[56] References Cited

U.S. PATENT DOCUMENTS

| | | | |
|---|---|---|---|
| 2,913,575 | 11/1959 | Lipscomb | 240/106 R X |
| 2,993,115 | 7/1961 | Rosenblatt | 240/51.11 R |
| 3,116,885 | 1/1964 | Morse | 240/92 |
| 3,168,987 | 2/1965 | Heisler | 240/51.11 R |
| 3,188,461 | 6/1965 | Lipscomb | 240/106 R X |
| 3,248,533 | 4/1966 | Mathis | 240/51.11 R |
| 3,869,606 | 3/1975 | Fordsmand | 240/51.11 R |
| 3,908,120 | 9/1975 | Greene | 240/51.11 R |

FOREIGN PATENT DOCUMENTS

| | | | |
|---|---|---|---|
| 233,843 | 5/1961 | Australia | 240/106 |
| 235,175 | 8/1961 | Australia | 240/106 |
| 1,276,796 | 10/1961 | France | 240/106 |
| 859,429 | 1/1961 | United Kingdom | 240/106 |

*Primary Examiner*—L. T. Hix
*Assistant Examiner*—William B. Perket
*Attorney, Agent, or Firm*—Fay & Sharpe

[57] ABSTRACT

A light diffuser attachment particularly adapted for use with a self contained fluorescent lamp fixture of the type having a fixture body cover which includes the fluorescent tube and operative components therein and a diffuser receiving flange or rim thereon. The diffuser attachment has a generally box-like configuration and is fabricated from conventional plastic diffuser material so as to have a bottom wall, side walls, end walls and an open top end. Locating and mounting beads are disposed generally longitudinally along the inside of the diffuser side walls adjacent the open end. Selected of the beads on each side wall are laterally spaced apart from each other to define a flange or rim receiving channel therebetween which receives the diffuser receiving flange or rim of the fixture body cover therein. Preferably, the diffuser attachment side walls are bowed slightly arcuately inward toward each other at least adjacent the open top end in order that the side walls will exert a continuous biasing force against the fixture body cover. The overall arrangement is such that heat is dissipated from inside the attachment by small air gaps disposed at each end thereof adjacent the ends of the fixture body cover.

7 Claims, 8 Drawing Figures

FIG. 4
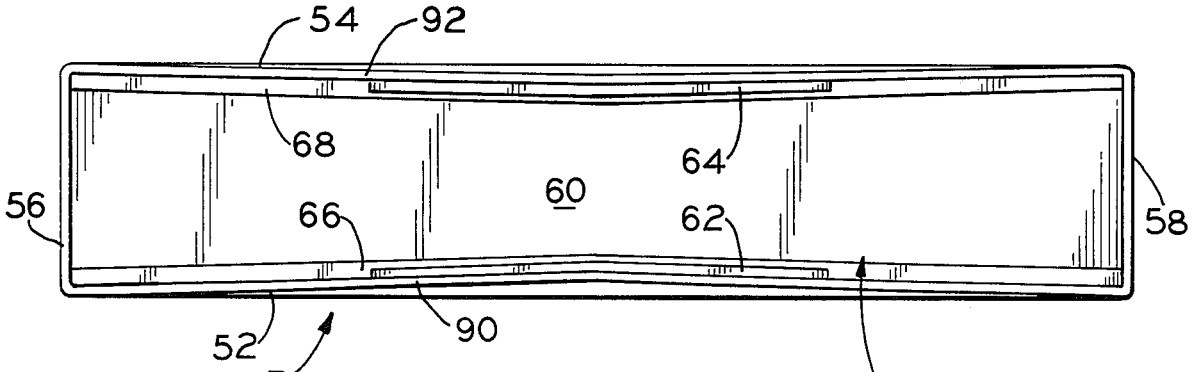
FIG. 5
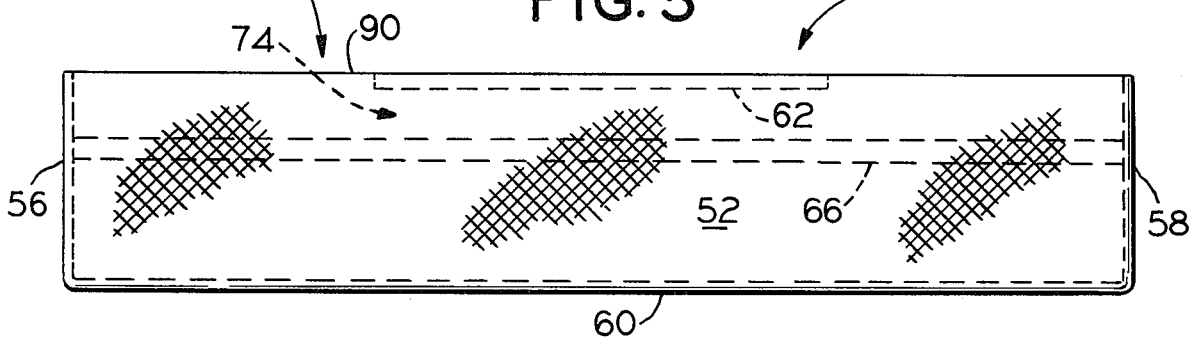
FIG. 6
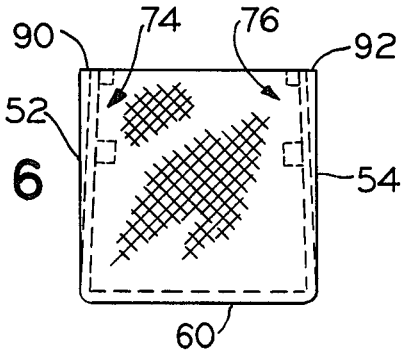
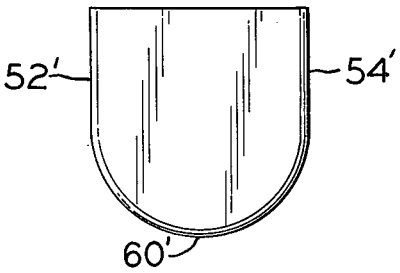
FIG. 7
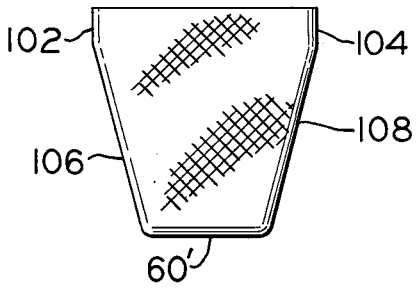
FIG. 8

DIFFUSER ATTACHMENT FOR A FLUORESCENT LAMP FIXTURE

BACKGROUND OF THE INVENTION

This application pertains to the art of fluorescent lamp fixtures and more particularly to light diffuser attachments for such fixtures.

The invention is particularly applicable to a diffuser attachment for a self-contained fluorescent lamp fixture and will be described with particular reference thereto; however, it will be appreciated by those skilled in the art that the invention has broader applications and is applicable to other environments where diffuser attachments may be advantageously employed.

Heretofore, in most conventional fluorescent lamp fixtures, the light diffusers associated therewith have been many and varied in both style and design. However, almost all of the prior diffuser attachments or shields have required auxiliary tools and/or complicated installation and removal instructions in order to gain access to the fluorescent tubes for purposes of maintenance and/or replacement. While such diffusers have proved readily acceptable for use on conventional fluorescent lamp fixtures, they are not acceptable for use on self-contained fluorescent lamp fixtures. In most conventional fixtures, the fixtures are generally recessed within the ceiling or wall area such that the diffusers oftentimes merely comprise a generally flat member generally coplanar with the ceiling or wall surface itself. As such, this type of prior diffuser has normally either been hinged on one side thereof to facilitate a downward swinging movement for purposes of gaining access into the fixture or are fitted to be slid into and out of the fixture framework to gain such access.

Such arrangements typically do not provide for adequate dissipation of heat generated by the fluorescent tube which substantially lessens the life expectancy and lumens output of the tube.

Those conventional fluorescent lamp fixtures which were not recess mounted or had diffusers which did include some box-like form have difficulties the same as and similar to those noted above. Typically, the fluorescent tubes are not fully enclosed or are enclosed to an extent that the lumens output from the tubes is not efficiently or effectively distributed. The same heat dissipation and complicated diffuser mounting means are also very much present in these prior types of fluorescent lamp fixture and diffuser arrangements. In addition, the aesthetics of many prior diffusers were virtually ignored so that the overall aesthetic value of an entire area could be substantially reduced through their use.

The subject diffuser attachment is primarily directed toward self-contained fluorescent lamp fixtures. In this vein, a self-contained fluorescent fixture is deemed to be one adapted for installation into a conventional incandescent lamp socket outlet for purposes of converting conventional incandescent lighting to fluorescent lighting. Such fixtures are deemed advantageous in order to achieve the same level of illumination as incandescent lighting while consuming only approximately ¼ to ⅓ as much electrical energy. In addition, fluorescent tubes have a life expectancy which is between 10 and 25 times longer than incandescent bulbs. However, since the self-contained type fluorescent fixtures are received in conventional incandescent lamp socket outlets, they normally protrude from a wall or ceiling area. Thus, the conventional diffuser designs heretofore known are not readily adaptable or particularly desired for use for those primary reasons already discussed. Disclosures of the type of self-contained fluorescent lamp fixtures to which the subject invention is principally directed may be found in the commonly assigned, co-pending patent application Ser. Nos. 480,419, filed June 18, 1974, now U.S. Pat. No. 3,908,120; 500,252, filed Aug. 26, 1974, now abandoned; and, 528,627, filed Dec. 2, 1974, the teachings of which, at least as to the type of self-contained fluorescent fixture involved, are incorporated hereinto by reference.

The present invention contemplates a new and improved diffuser attachment which overcomes all of the above referred to problems and others and provides a diffuser attachment which is simple, economical, enhances the aesthetic value of self-contained fluorescent lamp fixtures, and provides quick and easy means for removing and installing the diffuser attachment relative to a fixture and which is readily adaptable for use in any number of lighting environments.

BRIEF DESCRIPTION OF THE PRESENT INVENTION

In accordance with the present invention, a new and improved light diffuser attachment is provided for a fluorescent lamp fixture of the type which includes a socket adaptor for installing the fixture in a conventional incandescent lamp fixture. The fluorescent lamp fixture includes a fixture body cover adapted to receive and support a fluorescent light tube and its operative components in operative association with the socket adaptor. The fixture body cover includes at least a pair of opposed side walls which include an outwardly protruding flange or rim having a predetermined width extending longitudinally therealong. The new and improved diffuser attachment comprises a generally box-like configuration having a bottom wall, a pair of spaced apart side walls, a pair of spaced apart end walls and an open top end. First and second diffuser locating and mounting beads or strips are disposed generally longitudinally along the inside of each diffuser side wall adjacent the open end and selected of the beads are laterally spaced apart from each other a distance slightly greater than the width of the rim in order to define a rim receiving channel therebetween. At least the first of those beads located closest to the open end of the diffuser extend only over a portion of the length of the diffuser side walls.

In accordance with another aspect of the present invention, the diffuser attachment is constructed from a resilient light diffusing material and the side walls are formed so as to bow slightly arcuately inward each other at least adjacent the open end and the first and second beads. The side walls thus apply a continuous biasing force against the fixture body cover when the diffuser is received thereon.

In accordance with still another aspect of the present invention, the inside length of the diffuser is slightly greater than the outside length of the fixture body cover in order that air heated by operation of the fluorescent tube may pass outwardly from within the diffuser.

In accordance with yet another aspect of the present invention, at least the first beads are generally centrally disposed longitudinally along the side walls for balancing the diffuser mounting.

The principal object of the present invention is the provision of a new and improved diffuser attachment which will efficiently and economically permit the simple installation and removal of the attachment relative to an associated fluorescent lamp fixture.

Another object of the present invention is the provision of a new and improved diffuser attachment which eliminates the necessity for using any auxiliary tools to install or remove the attachment.

Still another object of the present invention is the provision of a new and improved diffuser attachment which eliminates physical contact between the attachment and the fluorescent tube which might otherwise tend to place physical stress on the tube.

A further object of the present invention is the provision of a new and improved diffuser attachment which facilitates air flow to and from the fluorescent tube for cooling purposes.

Yet a further object of the present invention is the provision of a new and improved diffuser attachment which has improved aesthetic qualities.

Still a further object of the present invention is the provision of a new and improved diffuser attachment which effectively transmits an increased amount of the lumens output of a fluorescent tube.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein:

FIG. 4 is a plan view of the diffuser attachment;

FIG. 5 is a side elevational view of the diffuser attachment;

FIG. 6 is an end view of the diffuser attachment;

FIG. 7 is an end view of another configuration of the diffuser attachment incorporating the concepts of the subject invention thereinto; and, FIG. 8 is an end view of still another alternative arrangement of a diffuser attachment incorporating the concepts of the subject invention.

DESCRIPTION OF THE PREFERRED EMBODIMENT

Figure 1:
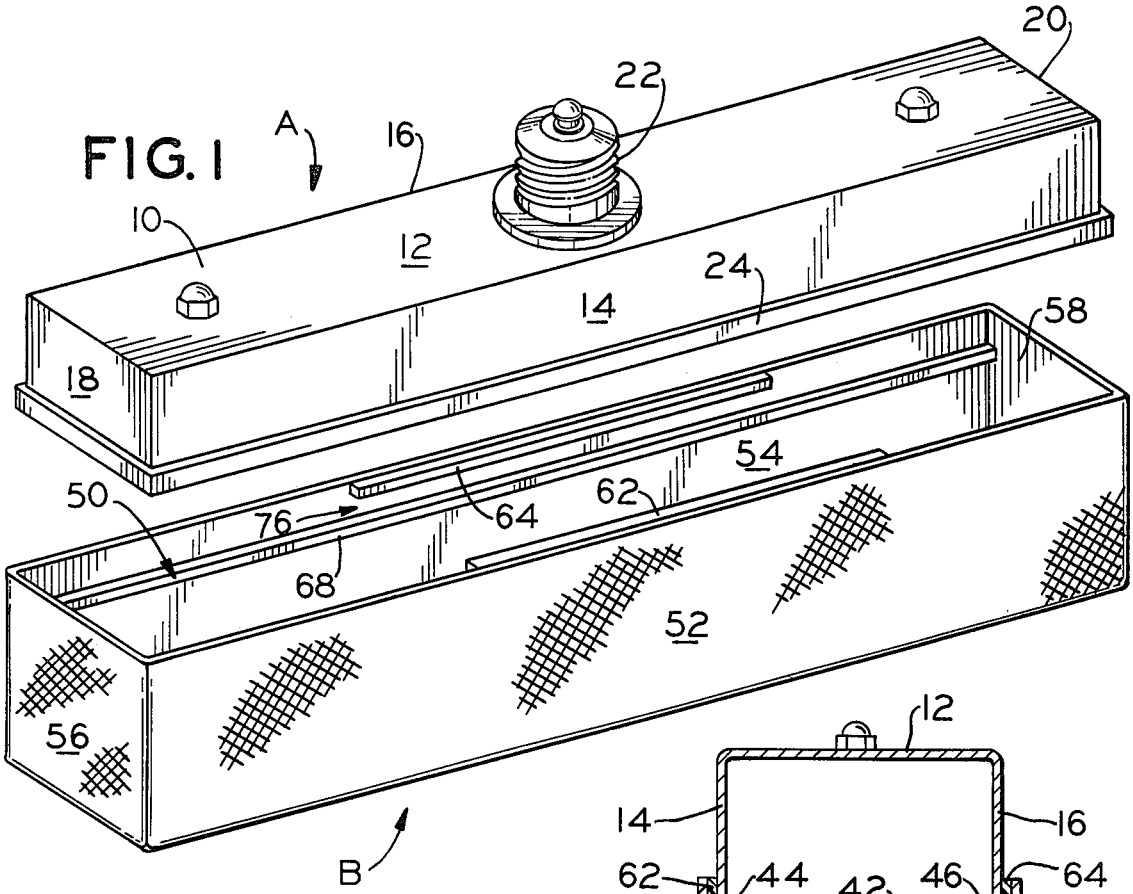
FIG. 1 is an exploded perspective view showing a self-contained fluorescent lamp fixture and the subject new diffuser attachment with the fluorescent tube removed from the fixture for ease of illustration.

Referring now to the drawings wherein the showings are for purposes of illustrating the preferred embodiment of the invention only, and not for purposes of limiting same, the FIGURES show a fluorescent lamp fixture A and a diffuser attachment B.

More specifically, the fluorescent lamp fixture includes a fixture body cover 10 having a top wall 12, opposed side walls 14, 16 and opposed end walls 18, 20. In the arrangement shown, the fixture body cover defines an open box-like configuration. Protruding outwardly from top wall 12 is a male socket adaptor 22 and extending peripherally around walls 14, 16, 18 and 20 adjacent the open end of the fixture body cover is a continuous outwardly protruding rim or flange 24. The details of this rim or flange will be discussed in detail hereinafter. The operation and use of the fluorescent lamp fixture A is not deemed to comprise a part of the present invention but may be readily ascertained from the commonly assigned, copending patent application Ser. Nos. 480,419 filed June 18, 1974, now U.S. Pat. No. 3,908,120; 500,252 filed Aug. 26, 1974, now abandoned; and, 528,627 filed Dec. 2, 1974, the teachings of which are incorporated hereinto by reference. Since the lamp fixture itself does not comprise a part of the present invention, futher specific elaboration thereon is not deemed necessary to a full and complete understanding of the present invention.

Figure 3:
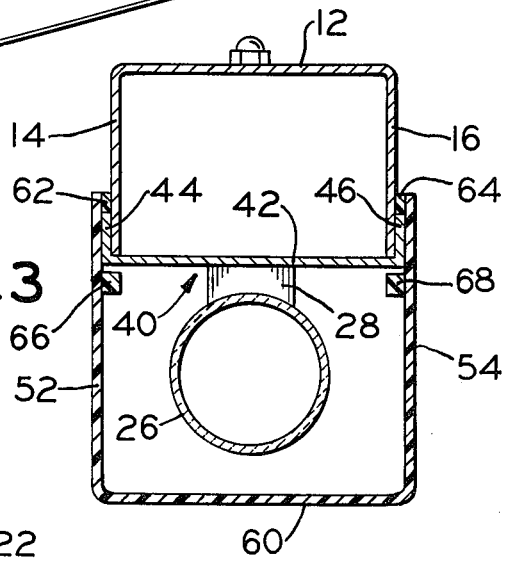
FIG. 3 is a cross-sectional view taken along lines 3—3 of FIG. 2.

The fixture body cover 10 acts as a housing for a fluorescent tube and the operative components required therefor. In FIG. 3, this fluorescent tube is generally designated 26 and is maintained in a position depending from the cover by a pair of conventional end mounted tube mounting and holding members, one of which is generally designated 28 in FIG. 3. Again, the actual installation and operation of the tube does not comprise a portion of the present invention and is merely shown in order that the preferred environment in which the concepts of the subject invention are practiced may be fully appreciated.

In FIG. 3, rim 24 is shown as comprising a portion of a cover member 40 of substantially U-shape cross-sectional configuration having a base 42 and a pair of opposed legs 44, 46 extending substantially perpendicularly from base 42. Member 40 may be retained in the fixtue body cover by any convenient means. The base 42 is dimensioned such that legs 44, 46 will be closely received against side walls 14, 16, respectively, of fixture body cover 10. Any number of alternative arrangements may be employed to provide rim or flange 24 suitable for receiving the diffuser attachment without departing from the scope and intent of the present invention. The arrangement shown in FIG. 3, however, facilitates protection for the operative components housed in fixture body cover 10 and the side of base 42 facing fluorescent tube 26 may be conveniently made from or coated with a light reflective material for purposes of enhancing the overall lumens output of the fixture. Further, rim or flange 24 need not necessarily be continuous to extend along end walls 18, 20 of the fixture body cover. The arrangement for this rim as shown in the FIGURES is merely deemed to be the preferred one.

Figure 2:
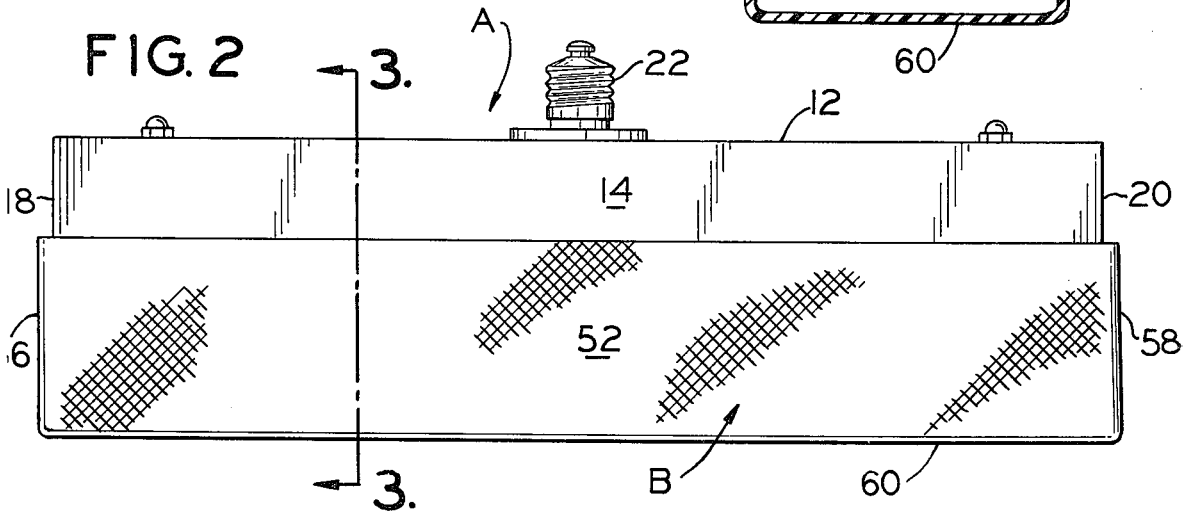
FIG. 2 is a side elevational view of the diffuser attachment as it is affixed to a self-contained fluorescent lamp fixture.

With reference to FIGS. 1, 2 and 3, the diffuser attachment B is shown as comprising a generally box-like configuration having a pair of opposed side walls 52, 54, a pair of opposed end walls 56, 58 and a bottom wall 60. As used herein, box-like configuration is not deemed to limit the diffuser to a rectangular configuration; rather, it is considered to include all configurations and modifications which define an enclosure having an opened top end. Two such modifications will be discussed hereinafter with reference to FIGS. 7 and 8. In the preferred arrangement of the invention, it is contemplated that the diffuser attachment will be fabricated from readily available and conventional plastic diffuser material. Such material normally is transparent having a patterned light diffusing surface on at least one side thereof, or merely translucent. Fabrication may be conveniently effected by adhesive or heat bonding techniques although other materials and construction techniques may be readily employed without departing from the intent and scope of the present invention.

Disposed along the inside of side walls 52, 54 adjacent the open end of the attachment as best shown in FIG. 4, 5 and 6 are elongated inwardly extending first lock bead or strip members 62, 64. For reasons which will become apparent hereinafter, these members are generally centrally disposed along the length of their respective side walls and each is preferably of a length equal to approximately 35–45% of the length of the side walls themselves. This range of lengths has been found to be particularly desirable for reasons which will become apparent hereinafter although they coupld be conveniently varied as may be desired. Laterally spaced from beads 62, 64 are second inwardly extending locating beads or strips 66 and 68. These beads are best shown in FIG. 4 and, combination with beads 62, 64, define rim receiving channels generally designated 74, 76 in FIGS. 5 and 6. Channels 74, 76 have a slightly greater width than the width of outwardly protruding rim or flange 24 on fixture body cover 10 to facilitate ease of installation and removal of the diffuser attachment. Each bead or strip 66, 68 preferably extends the entire length of side walls 52, 54 between end walls 56, 58, although other continuous locating bead arrangements could also be employed. It has been determined, however, that the above described preferred lengths on each side wall achieve the most satisfactory operational results at minimum cost. This preferred range also uniformly distributes mechanical stress over a sufficiently wide area of surface contact between the beads and the fixture body cover.

Beads or strips 62, 64, 66 and 68 may comprise a plastic material adhesively, or otherwise affixed to side walls 52, 54. While the configuration and number of these beads for the preferred embodiment of the invention is as shown in the FIGURES, variations of the number or configuration of the beads could be employed without departing from the intent or scope of the present invention. For example, in the event the diffuser is molded, the beads could be formed intergral with the side walls. Similarly, it may be desired to replace continuous locating beads or strips 66, 68 with a plurality of shorter beads, that is, make the second beads discontinuous or intermittent. While adding to the overall assembly cost for the diffuser attachment, this alternative can increase heat dissipation from within the attachment when it is in actual use.

With reference to FIGS. 4, 5 and 6, it will be noted that side walls 52, 54 are desirably constructed so as to bow slightly arcuately inward toward each other at least adjacent uppermost edges 90, 92 of side walls 52, 54, including the area of the side walls upon which the first and second beads are located. This arrangement provides an inherent or built in force means for continuously forcing the side walls into positive engagement with the fixture body cover when the diffuser is located therein in order that the diffuser may be securely retained thereon. At generally the central portions of side walls 52, 54, the arcuate formation of the side walls is such that the distance between them is less than the width of the fixture body cover itself. While the actual degree of arcuate deflection may vary as necessary or desired, it has been found that an inwardly deflected case or bow of 1° on each side wall is preferred.

In addition, the length of the diffuser attachment between end walls 56, 58 is slightly greater than the outside length of fixture body cover 10 between ends 18, 20 and the portion of rim 24 included thereon. this dimensional relationship is considered particularly desirable and advantageous for purposes of heat dissipation as will become more readily apparent hereinafter. In the preferred embodiment, end walls 56, 58 are disposed generally normal to bottom wall 60. While it is possible to slightly cant or rake end walls 56, 58 outwardly of each other from bottom wall 60 toward the open top end for heat dissipation purposes, such an alternative structure adds unnecessary assembly costs to the attachment.

With fluorescent lamp fixture A installed in a conventional incandescent lamp socket, the subject diffuser attachment, with locking beads or strips 62, 64 and locating beads or strips 66, 68, merely requires an outward pressure at one juncture along the side walls in order to effectively spread these walls an amount sufficient to facilitate passing of beads or strips 62, 64 over continuous rim or flange 24. This may be easily done by hand without the necessity of any auxiliary tools or special installation or removal procedures. Removal of the diffuser attachment is effected by merely reversing the steps noted above. Because of the shorter length of strips or beads 62, 64 relative to the length of side walls 52, 54 as well as their central location thereon and because the length of the attachment is greater than the length of the fixture body cover, installation and removal of the diffuser attachment is made quite simple. No difficulty or interference is encountered with rim of flange 24 adjacent end walls 56, 58 of the attachment where deflection of the side walls becomes less possible and far more difficult.

The inward bowing of side walls 52, 54 operates to exert a continuous pressure upon the discontinuous centermost beads or strips 62, 64 in cooperation with rim or flange 24 of the fixture body cover and, as noted above, the width of channels 74, 76 is slightly greater than the width of rim 24. Thus, the fit of the diffuser over rim 24 is snug or tight at the area of interconnection therebetween and the dimensioning of the type of bead or strip arrangement described facilitates the forming of small air gaps between the diffuser attachment and the fixture body cover whereby heat is permitted to escape from the interior of the diffuser. Further, the physical weight of the subject diffuser attachment upon rim 24 is sufficient to circumvent rattling noises as may be otherwise created by low magnitude vibrations normally present in most buildings. The difference in length between the attachment and the fixture body cover establishes small laterally spaced openings which have also been found effective to further dissipate heated air from the interior of the diffuser. This feature is significant since the hottest portions of an electrified fluorescent lamp tube are at the cathode ends of the tube where electric discharge occurs, that is, adjacent end walls 56, 58. These physical characteristics in the subject diffuser attachment are deemed to be extremely beneficial since it is an established fact in the art that heat generated from a fluorescent tube can substantially lessen the life expectancy and the lumens output of the tube if the heat is not effectively dissipated.

As to possible alternative configurations for the diffuser attachment B, attention is particularly invited to the end views of two such alternatives shown in FIGS. 7 and 8. The inventive concepts are deemed equally applicable to these alternatives. For ease of reference and appreciation of these modifications and alternatives, like components are identified by like numerals and further including a primed (') suffix. Accordingly, in FIG. 7, side walls 52', 54' are parallel to each other much the same as that described with reference to the preferred embodiment. However, bottom wall 60' is curved or generally semi-circular in cross-sectional configuration joining side walls 52', 54' at their lowermost ends. Here, walls 52', 54' and 60' could comprise a single piece of plastic diffuser material formed into the configuration shown. In the FIG. 8 alternative, the side walls are each comprised of two sections. That is, each side wall has opposed generally parallel sections 102, 104 and a pair of opposed converging sections 106, 108 converging from portions 102, 104 toward bottom wall 60'.

Of course, other diffuser attachment configurations are also possible. Thus, the description and structural concepts contemplated with regard to the preferred embodiment are deemed equally applicable to not only the alternative arrangements shown in FIGS. 7 and 8, but also to other possible alternatives.

The invention has been described with reference to the preferred embodiment. Obviously, modifications and alterations will occur to others upon the reading and understanding of the specification. It is our intention to include all such modifications and alternations insofar as they come within the scope of the appended claims or the equivalents thereof.

Having thus described our invention, we now claim:

1. In a self-contained fluorescent lamp fixture of the type having a box-like fixture body adapted to support a fluorescent light tube and receive its operative components in operative association with fixture mounting means wherein the fixture body has a pair of opposed sides between which an open end of said fixture body is defined and with each side including an outwardly protruding flange area having a predetermined width extending longitudinally therealong, a cover member of substantially U-shaped cross-sectional configuration including a base having integral legs extending substantially perpendicularly from the opposite sides thereof, said cover member being attached to said fixture body with said base spanning said open end of said fixture body and with said sides of said fixture body positioned between said legs and closely received thereagainst so that said legs define said flange areas, a light diffuser attachment for said fluorescent lamp fixture, said diffuser having a generally box-like configuration including a bottom wall, a pair of spaced apart side walls, a pair of spaced apart end walls and an open top end with at least said top end being dimensioned to be received over said flange areas on said fixture body; first and second diffuser locating and mounting beads disposed generally longitudinally along the inside of each diffuser side wall adjacent said open top end with said first and second beads laterally spaced apart from each other a distance slightly greater than the predetermined width of said flange areas so as to define a flange area receiving channel therebetween, said first and second beads extending over at least a portion of the length of said diffuser side walls; and, said diffuser side walls being formed so as to bow slightly arcuately inward toward each other such that the transverse distance between them at least generally midway between said end walls at least adjacent said open top end and said first and second beads is less than the transverse distance between the outside surfaces of said fixture body sides, said diffuser attachment being affixed to said fixture body by means of the flange areas of said sides being received in said receiving channels with at least the inwardly most bowed areas of said diffuser side walls applying a continuous clamping force against said fixture body sides, and with said flange areas received between said first and second beads on said sidewalls over a distance less than the longitudinal length of each said diffuser sidewalls.

2. The lamp fixture as defined in claim 1 wherein said diffuser is constructed from a resilient light diffusing material.

3. The lamp fixture as defined in claim 1 wherein the distance between said end walls of said attachment is slightly greater than the length of said fixture body.

4. The lamp fixture as defined in claim 1 wherein at least said first beads are intermittently spaced along said side walls.

5. The lamp fixture as defined in claim 4 wherein said first beads are generally centrally disposed longitudinally along said side walls, said second beads being longitudinally continuous between said end walls.

6. The lamp fixture as defined in claim 5 wherein each side wall includes one first bead adjacent said open top end and a second bead laterally spaced along each side wall from said first bead toward said bottom wall.

7. The lamp fixture as defined in claim 1 wherein the combined length of said first and second beads on each side wall is in the range of 135 to 145% of the length of each side wall.

* * * * *